United States Patent [19]

Paquette et al.

[11] 4,101,044

[45] Jul. 18, 1978

[54] CLOSURE CAP AND SUPPORT FOR HOLDING A BOTTLE OF CARBONATED BEVERAGE IN INVERTED POSITION

[76] Inventors: Francis A. Paquette, 4308 Shamrock Way; Richard H. Henze, 17647 Trenton Dr., both of Castro Valley, Calif. 94546

[21] Appl. No.: 818,001

[22] Filed: Jul. 22, 1977

[51] Int. Cl.[2] ..... B65D 47/40

[52] U.S. Cl. ..... 215/228; 215/100.5

[58] Field of Search ..... 215/228, 329, 341, 354, 215/100 R, 100.5

[56] References Cited

U.S. PATENT DOCUMENTS

| | | | |
|---|---|---|---|
| 2,222,771 | 11/1940 | Hoffman | 215/341 |
| 2,990,080 | 6/1961 | Harris | 215/228 X |
| 3,000,525 | 9/1961 | Leslie-Smith | 215/329 X |
| 3,317,069 | 5/1967 | Chin | 215/228 X |
| 3,402,844 | 9/1968 | Chin | 215/329 X |

FOREIGN PATENT DOCUMENTS

| | | | |
|---|---|---|---|
| 1,505,394 | 11/1967 | France | 215/100 R |

*Primary Examiner*—Donald F. Norton
*Attorney, Agent, or Firm*—William R. Piper

[57] ABSTRACT

A single piece closure cap and support for holding a bottle of carbonated beverage in an inverted position in which the cap has a center threaded recess for receiving the threaded bottle neck for securing the cap to the bottle. The inner end of the recess has a raised portion for entering the bottle neck for sealing the bottle. The device has a circular reservoir surrouding the bottle neck for catching any leakage therefrom and this reservoir enlarges the base area of the cap to such an extent as to prevent the inverted bottle from accidentally tipping over when the cap supports the bottle.

1 Claim, 3 Drawing Figures

CLOSURE CAP AND SUPPORT FOR HOLDING A BOTTLE OF CARBONATED BEVERAGE IN INVERTED POSITION

CROSS REFERENCE TO RELATED APPLICATION

The joint inventors filed a patent application on a rack for holding bottles with carbonated beverages in inverted positions on May 10, 1977; Ser. No. 795,483. In our copending application we disclosed a rack for supporting a plurality of beverage containing bottles in inverted positions, so that the liquids therein would fill the capped ends and prevent any gases from escaping. The rack had a reservoir to catch any liquid that might leak from the inverted bottles.

SUMMARY OF THE INVENTION

An object of our invention is to provide a single moulded unit designed to have two basic functions: (1) to act as a cap for the bottle for sealing its contents after the bottle has been initially opened and only a small portion of its liquid contents poured out; and (2) to act as a support for holding the bottle in an inverted position so that the liquid in the bottle will fill the capped end and prevent any escape of gases therefrom. The cap has a broad enough base portion to prevent the inverted bottle from accidentally tipping over and it has a reservoir for catching any liquid that might leak from the bottle.

DESCRIPTION OF THE PREFERRED EMBODIMENT

Figure 1:
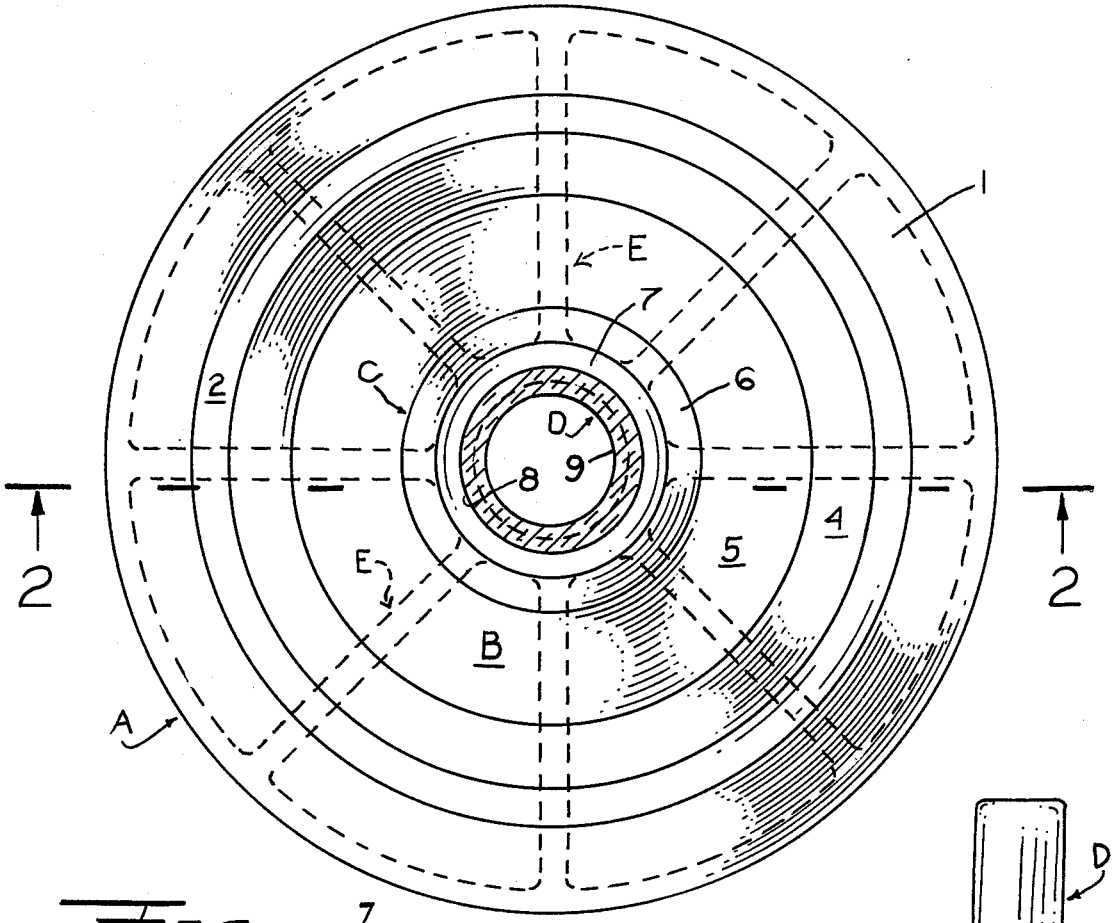
FIG. 1 is a full-sized top plan view of the device and it is taken along the line 1—1 of FIG. 2, and shows the inverted bottle neck in section.
Figure 3:
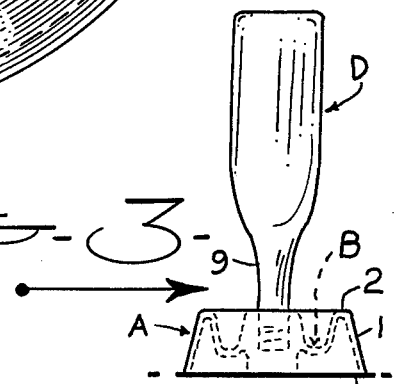
FIG. 3 is a front elevation of the device on a smaller scale and shows the device as acting as a cap for the bottle and also functioning as a support for holding the bottle in an inverted position. The device has a circular reservoir surrounding the bottle neck for retaining any leakage from the bottle.

In carrying out our invention we provide a single unit closure cap and bottle support indicated generally at A, that may be made or molded from any desired material such as plastic. The device may be circular or non-circular in shape and we show it circular in FIG. 1. The outer rim 1 has a slight taper and the circular top 2 is spaced above the lower edge 3 of the outer inwardly tapered rim 1.

Figure 2:
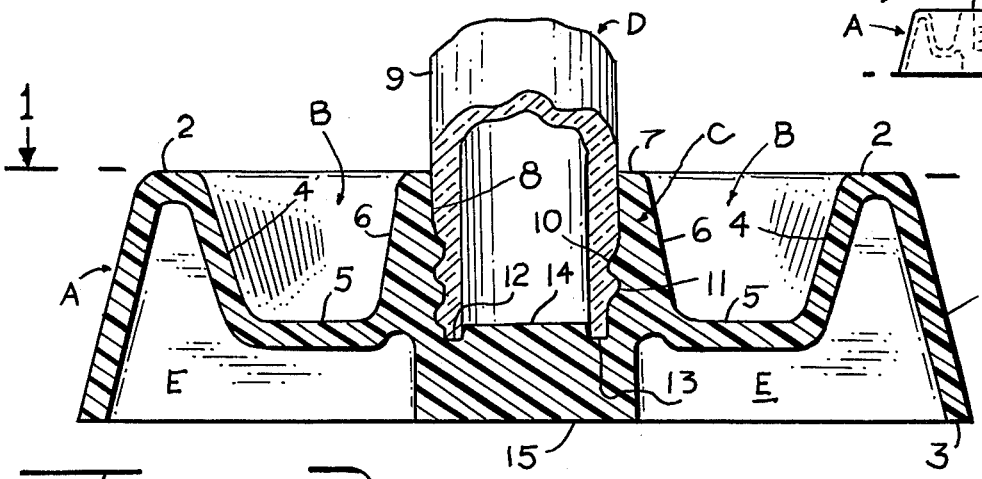
FIG. 2 is a transverse section taken along the line 2—2 of FIG. 1, and illustrates the bottle neck partly in section.

The closure cap and bottle support A has a circular reservoir B, whose outer tapered wall 4 extends downwardly and inwardly from the circular top 2, see FIG. 2. This wall 4 does not extend to the plane of the lower edge 3, but merges into a horizontal bottom wall 5, that is spaced above the lower edge 3. The inner tapered wall 6 of the reservoir B, extends upwardly from the bottom wall 5. The top 7 of the reservoir inner wall 6, lies in the same plane as the circular top 2.

The center portion C, of the closure cap and bottle support A, has a cavity 8 with a cylindrical wall whose central axis coincides with the center of the lower circular edge 3. The diameter of the cylindrical cavity 8 is substantially the same as the outer diameter of the neck 9 of a carbonated beverage containing bottle D, so that the bottle neck will be snugly received in the cavity. Also, the wall of the cavity is provided with threads 10 that will receive the threaded portion 11 of the bottle neck 9, see FIG. 2. This permits the closure cap and bottle support A to be screwed onto the open end of the beverage containing bottle D, after which the bottle and device may be inverted and the device used for supporting the inverted bottle so that the beverage will fill the bottle neck and prevent the carbonated gas from leaking from the bottle.

As a further precaution against any leakage of the liquid contents from the bottle D, we provide a circular groove 12 at the bottom of the cavity 8 and which opens into the cavity. This circular groove snugly receives the rim 13 of the bottle neck 9. It will be seen that this arrangement will provide a central raised projection 14 that will be forced into the bottle neck 9 and will function as a liquid tight seal for the open top of the bottle.

Our closure cap and bottle support A, is reinforced by radially extending ribs E whose outer edges are integral with the inner surface of the tapered rim 1 and whose inner edges are integral with the central portion C of the device. FIG. 2 shows the bottom 15 of the central portion C, lying in the same plane as the lower edge 3 of the rim 1. The radial ribs E, are also integral with the adjacent surfaces of the tapered wall 4 and the bottom wall 5 of the reservoir B.

OPERATION

From the foregoing description of the various parts of the device, the operation thereof may be readily understood. As already stated, the closure cap and bottle support is a single unit in which the diameter of the device is much greater than would otherwise be required for merely capping a bottle. This is for the purpose of providing a large area base for supporting the bottle in an inverted position and for preventing the bottle from accidentally tipping over. In addition the large area base makes it possible to provide a circular-shaped reservoir which surrounds the bottle neck for catching any leakage from the bottle while it is held in an inverted position. The radially extending ribs E strengthens the device.

The closure cap portion of the device has the central raised portion 14 at the bottom of the central cavity 8 for actually entering the bottle neck a slight distance for sealing the liquid contents in the bottle. The threaded portion 10 in the cylindrical cavity wall permits the device to be screwed tightly into place on the threaded portion 11 of the bottle neck and this will force the rim 13 of the neck down into the bottom of the circular groove 12 and will force the raised central portion 14 into the bottle neck interior for forming a liquid tight seal for the liquid contents in the bottle. The device will hold the partly filled bottle of liquid in an inverted position so that the liquid will fill the capped end of the bottle and prevent the escape of the carbonated gas therefrom.

We claim:

1. A closure cap and support for holding a bottle of a carbonated beverage in an inverted position: comprising (a) a single molded unit with a large area base substantially greater than the large diameter of the bottle, said base being defined by an outer annular wall extending upwardly and inclined inwardly from a planar surface and extending to a juncture with an inner annular wall that slopes downwardly and inwardly to form an inverted V cross sectional configuration;

(b) the lower end of said inner annular wall terminating and forming an integral connection with a horizontal bottom wall that is spaced above the aforementioned planar surface;

(c) said base having a center portion integral with said bottom wall and having a central cylindrical internally threaded cavity for receiving the exteriorily threaded neck of a bottle containing a carbonated beverage, the axis of said cylindrical cavity coinciding with the axis of said base and being normal to the planar surface, the bottom of the cylindrical cavity lying substantially in the same plane as that of said bottom wall and the top of said center portion lying substantially in the same plane as the plane coinciding with the junction of said inner and outer annular walls;

(d) said center portion having an integral extension extending from the bottom of the cylindrical cavity to the planar surface so that the lower edge of the outer annular wall will lie in the same plane as the bottom of said integral extension of said center portion; and (e) a plurality of radially extending ribs whose inner ends are integral with the depending extension of said center portion and extend outwardly so that their outer ends are integral with the adjacent surfaces of said annular outer and inner inclined walls of said base, said ribs also adding weight to the base and being integral with the under surface of said bottom wall, the lower edges of said ribs lying in the same plane that coincides with the lower edge of said outer annular wall and with the bottom of said extension of said center portion;

(f) whereby the center of gravity for the uncapped inverted bottle supported by said base will lie at the center of said depending extension of said center portion and the center portion will cooperate with the annular inner wall and with the bottom wall to form a circular reservoir for receiving any leakage from the inverted bottle, the threaded cavity forming a liquid seal for the contents of the inverted uncapped bottle; said ribs adding weight and structural reinforcement for the various parts of said base.

* * * * *